US005782084A

United States Patent [19]

Jarvis

[11] Patent Number: 5,782,084

[45] Date of Patent: Jul. 21, 1998

[54] VARIABLE DISPLACEMENT AND DWELL DRIVE FOR STIRLING ENGINE

[75] Inventor: Hy T. Jarvis, Whittier, Calif.

[73] Assignee: Hyrum T. Jarvis, Whittier, Calif.

[21] Appl. No.: 481,798

[22] Filed: Jun. 7, 1995

[51] Int. Cl.[6] ..... F02G 1/04

[52] U.S. Cl. ..... 60/518; 60/517

[58] Field of Search ..... 60/517, 518, 519, 60/525

[56] References Cited

U.S. PATENT DOCUMENTS

| | | | |
|---|---|---|---|
| 3,319,416 | 5/1967 | Renshaw | 60/525 |
| 4,195,482 | 4/1980 | Moloney | 60/517 |
| 4,382,362 | 5/1983 | Mortel et al. | 60/517 |
| 4,532,819 | 8/1985 | Ross | 60/525 |
| 4,738,105 | 4/1988 | Ross et al. | 60/517 |
| 4,998,411 | 3/1991 | Lopez | 60/517 |
| 5,095,700 | 3/1992 | Bolger | 60/517 |
| 5,146,749 | 9/1992 | Wood et al. | 60/517 |

FOREIGN PATENT DOCUMENTS

| | | | |
|---|---|---|---|
| 0224448 | 12/1984 | Japan | 60/517 |

*Primary Examiner*—Stephen F. Husar
*Attorney, Agent, or Firm*—Lyon & Lyon LLP

[57] ABSTRACT

A Stirling cycle engine and drive mechanism therefor which may be configured in a Beta, Alpha or Gamma configuration for providing increased power output. The drive mechanism provides a dwell of the displacer piston at its top and/or bottom dead center positions of the displacer stroke. The drive mechanism includes adjustable regulatory linkages in order to adjust the dwell and stroke of the displacer piston as well as the phase angle between the displacer and power pistons.

18 Claims, 17 Drawing Sheets

0 DEGREES

30 DEGREES

60 DEGREES

90 DEGREES

120 DEGREES

150 DEGREES

180 DEGREES

210 DEGREES

240 DEGREES

270 DEGREES

300 DEGREES

330 DEGREES

VARIABLE DISPLACEMENT AND DWELL DRIVE FOR STIRLING ENGINE

FIELD OF THE INVENTION

The field of the current invention relates generally to Stirling engines, and more particularly to a drive mechanism for Alpha, Beta and Gamma configuration Stirling engines.

BACKGROUND OF THE INVENTION

The Stirling engine has existed in one form or another since first being invented in the early 1800s by Scottish clergyman Robert Stirling. Though various aspects of the Stirling engine have been improved since then, all Stirling engines operate based on the thermodynamic laws surrounding the relationship between pressure, volume and temperature of a working fluid or gas as it is heated and cooled.

All Stirling engines typically include the following components in one form or another: cylinder(s), displacer piston and power piston which move in sinusoidal fashion within the cylinder(s), working fluid or gas control loop, regenerator or other heat exchanger/cooler mechanism and a drive system such as a kinematic mechanical linkage to couple the displacer and power pistons.

Stirling engines provide the benefits of quiet and efficient operation with little or no harmful emission. Furthermore, Stirling engines essentially operate on a fixed volume of working fluid or gas as opposed to the internal combustion engine which burns petroleum or some other fuel with air to produce the working fluid which is then vented in the exhaust cycle; an internal combustion engine thus requires continuous working fluid replenishment.

However, a lack of power output has typically been associated with the Stirling engine. Thus over the years, developmental efforts have focused on the internal combustion engine despite its drawbacks such as pollution, noise and the required continued replenishment of a depletable fuel source. A primary reason why Stirling engines have been unable to output sufficient power for various practical uses stems from the kinematic drive system used to couple the displacer and power pistons, and the drive system's relation to the thermodynamic reactions that occur as the working fluid or gas is heated and cooled.

As shown in FIG. 1, the ideal Stirling engine cycle 1 is typically plotted on a pressure-volume diagram in four phases: an isothermal compression curve 2, a constant volume heating line 3, an isothermal expansion curve 4 and a constant volume cooling line 5. In reality however, the pressure-volume plot of a Stirling engine cycle is represented by an ellipsoid 6 contained within the ideal Stirling cycle plot 1. This is essentially because the kinematic drive system necessarily maintains a phase difference between the displacer and power pistons in order for the engine to do work in the first place. To this end, kinematic drive systems used with existing Stirling engines generally position the phase of the displacer piston so that it leads the phase of the power piston by about 90 degrees.

Because of this phase difference, each of the above four phases 2 through 5 shown in the ideal Stirling cycle 1 are not completed before the next phase begins, thus resulting in ellipsoid 6. Unfortunately, this leads to a loss of work and power output, the amount of which may be graphically represented by the area between the ideal Stirling cycle plot 1 and the ellipsoid 6 contained therein.

This loss of power may also be explained with reference to FIGS. 2*a*–2*h* which depict a cylinder 10 of a typical Beta configured Stirling engine where the phase of displacer piston 11 is located 90 degrees ahead of the phase of power piston 12. In such Stirling engines, displacer piston 11 is held at its top dead center and bottom dead center positions only momentarily, i.e., at those discrete points in time when displacer piston 11 passes through the top and bottom dead center locations along its cyclical piston movement.

Because displacer piston 11 is 90 degrees ahead of power piston 12, displacer piston 11 already starts to travel back to the hot, or expansion, end 13 of cylinder 10 during the power stroke of power piston 12. Thus the volume of the cold, or compression, end 14 of cylinder 10 is expanding as the hot expanding gas enters therein. The ramification of this is that a portion of the force provided by the expansion of the hot gas is "consumed" by the expansion of the volume of cold end 14. That is, a portion of the hot expanding gas is allowed to expand into that volume of the cold end 14 that had just been occupied by the displacer piston 11 as shown in FIGS. 2*b* and 2*c*.

Accordingly, not all of the force provided by the expansion of the hot gas is exerted against power piston 12 during its power stroke. The result is that the power stroke of power piston 12 yields less work. Graphically, this is shown in FIG. 1 by the fact that phase 5 is begun before phase 4 is complete.

Thus it can be seen that power output of the Stirling engine would be increased if the displacer piston could be maintained at or near its bottom dead center position during the power stroke for more than the instantaneous time as in existing Stirling engines. This would enable more of the force provided by the expanding hot gas to be exerted against the power piston during the power stroke.

Existing Stirling engines however have not addressed this situation, but instead have sought to vary the power output by adjusting the phase angle between the displacer and power pistons. In the context of an automobile, such efforts have been pursued to accommodate the varying power required for, e.g., acceleration and constant velocity travel on a level road. To B this end, existing Stirling engines have used transmissions, planetary gears and other mechanical arrangements to vary the phase angle between 90 degrees, which is viewed as providing maximum power, and some other phase angle to provide lesser power. In such arrangements, the phase angle may also be adjusted to negative values to reverse the direction of the engine. Other arrangements have sought to increase or decrease the stroke of the displacer piston thereby increasing or decreasing power output.

In all these arrangements however, power is varied without first maximizing the power output of the Stirling engine itself. That is, no provision has been made for optimizing the work obtained from the power stroke. Rather, a less than optimum power output serves as the baseline for existing Stirling engines and power is varied therefrom. Accordingly, there is a need in the field of Stirling engines for a drive system that enables the Stirling engine to produce more work and power from the power stroke. This in turn would optimize the Stirling engine's overall power output.

SUMMARY OF THE INVENTION

In a first aspect of the current invention, a drive mechanism is described which provides increased power output from a Stirling Cycle engine.

In another aspect of the current invention, a drive mechanism which provides a dynamic "dwell" of a Stirling Cycle engine displacer piston at its maxima or minima positions, or both, is described.

In another aspect of the current invention, a drive mechanism with adjustable regulatory linkages is described.

In another aspect of the invention, a drive mechanism which may adjust the dwell and stroke of a displacer piston is described.

In another aspect of the current invention, a drive mechanism that is suitable for use with gamma, beta and alpha configuration Stirling engines is described.

DESCRIPTION OF THE PREFERRED EMBODIMENTS

Figure 1:
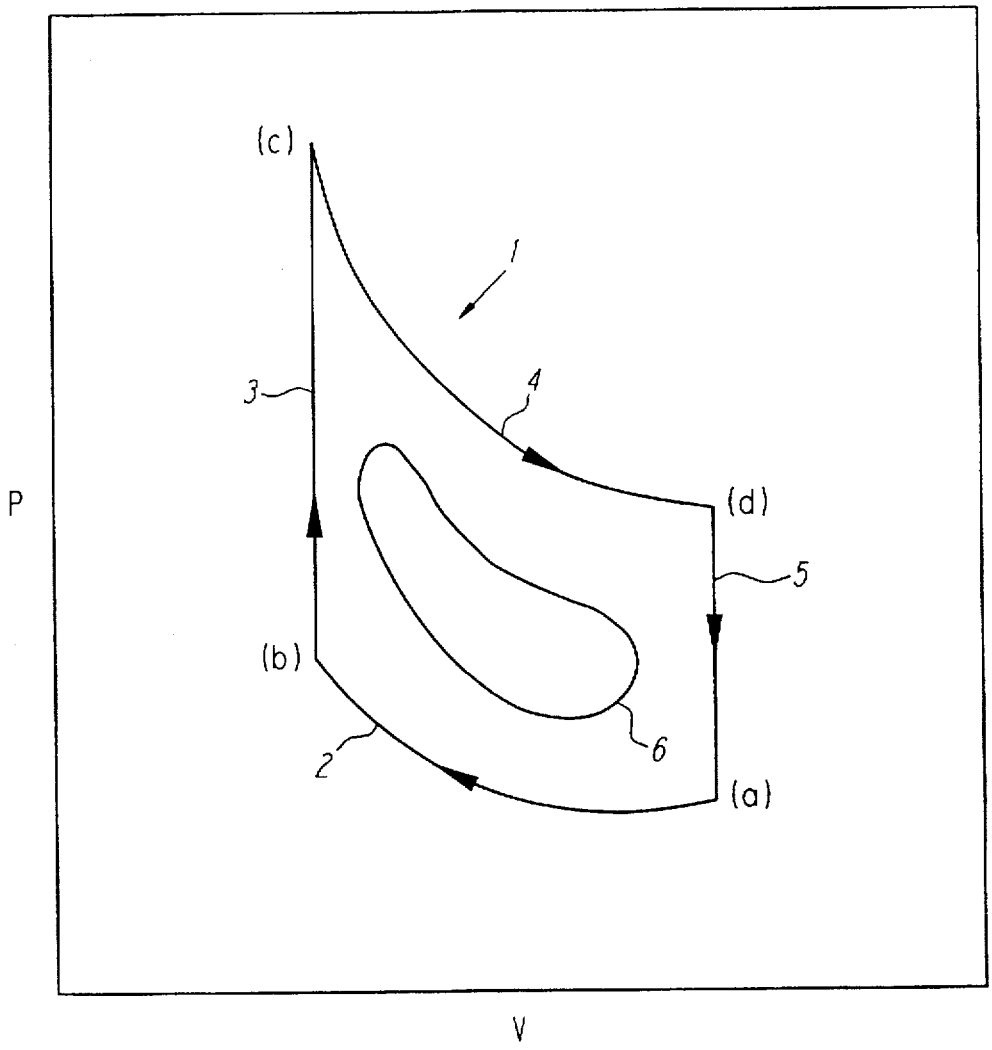
FIG. 1 shows ideal and practical Stirling engine cycle pressure-volume plots.
Figure 2:
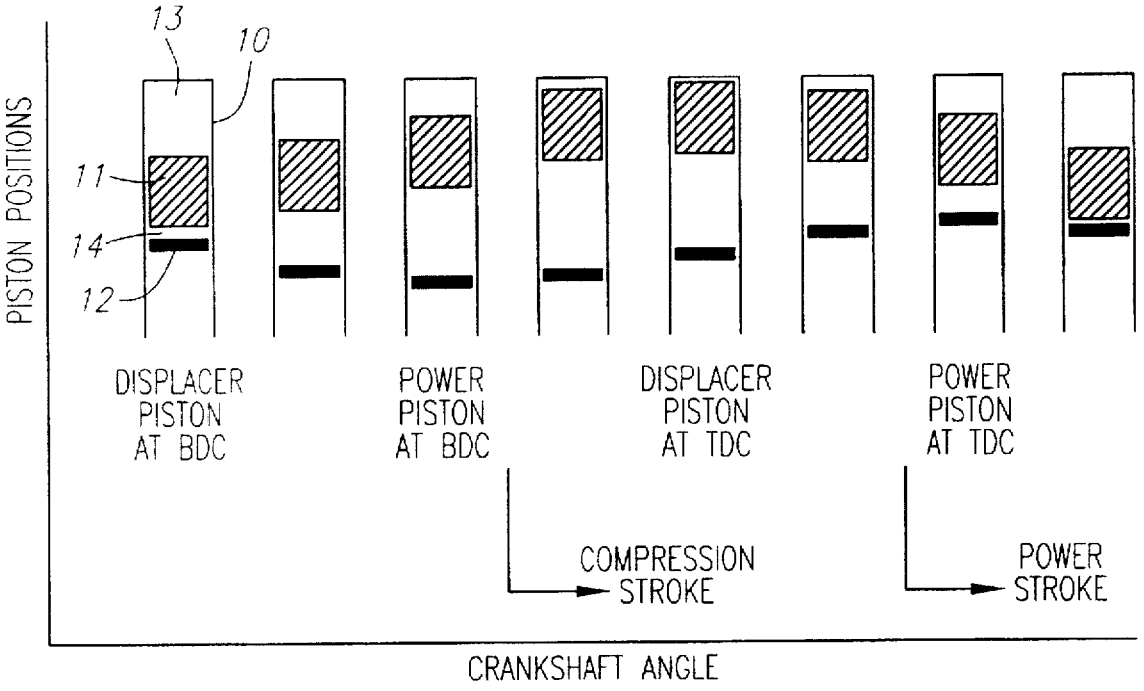
FIG. 2 (PRIOR ART)
FIG. 2 is a chart showing the relative locations of the displacer and power pistons in a Beta configured Stirling engine in which the displacer piston is 90 degrees in phase ahead of the power piston.
Figure 3:
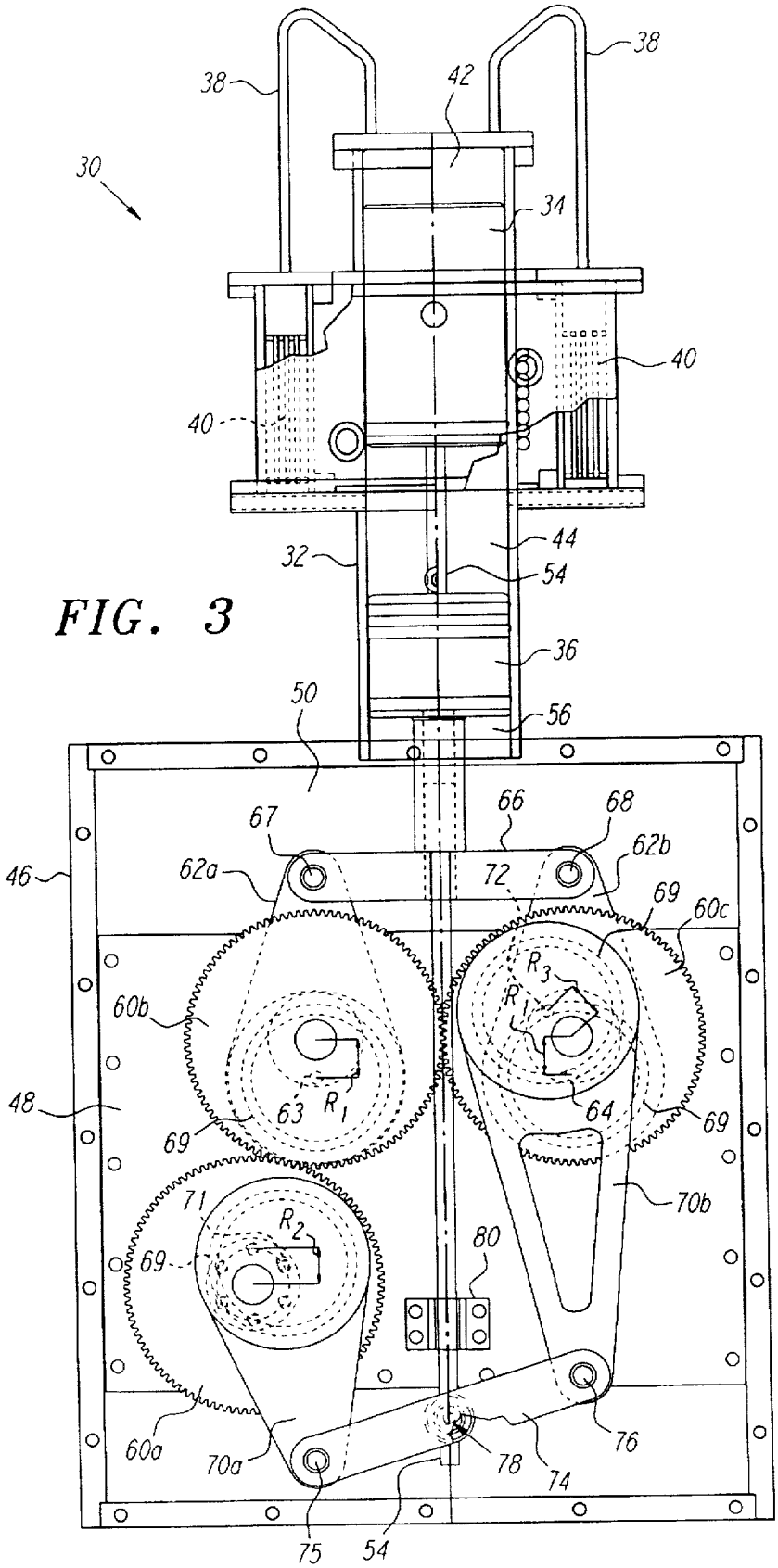
FIG. 3 is a front view of a Stirling engine and associated drive system.
Figure 4:
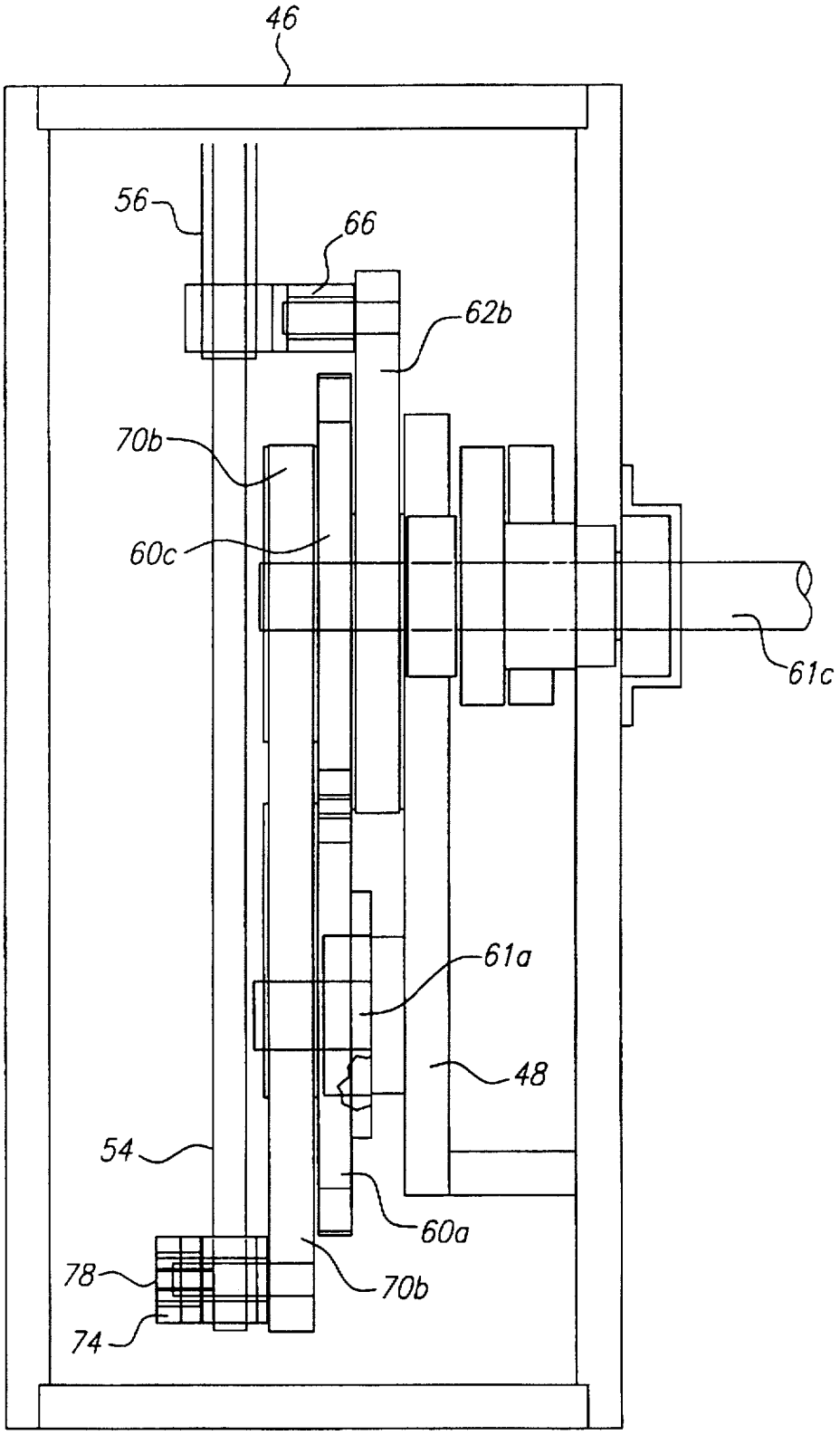
FIG. 4 is a right side view of a drive system.
Figure 5:
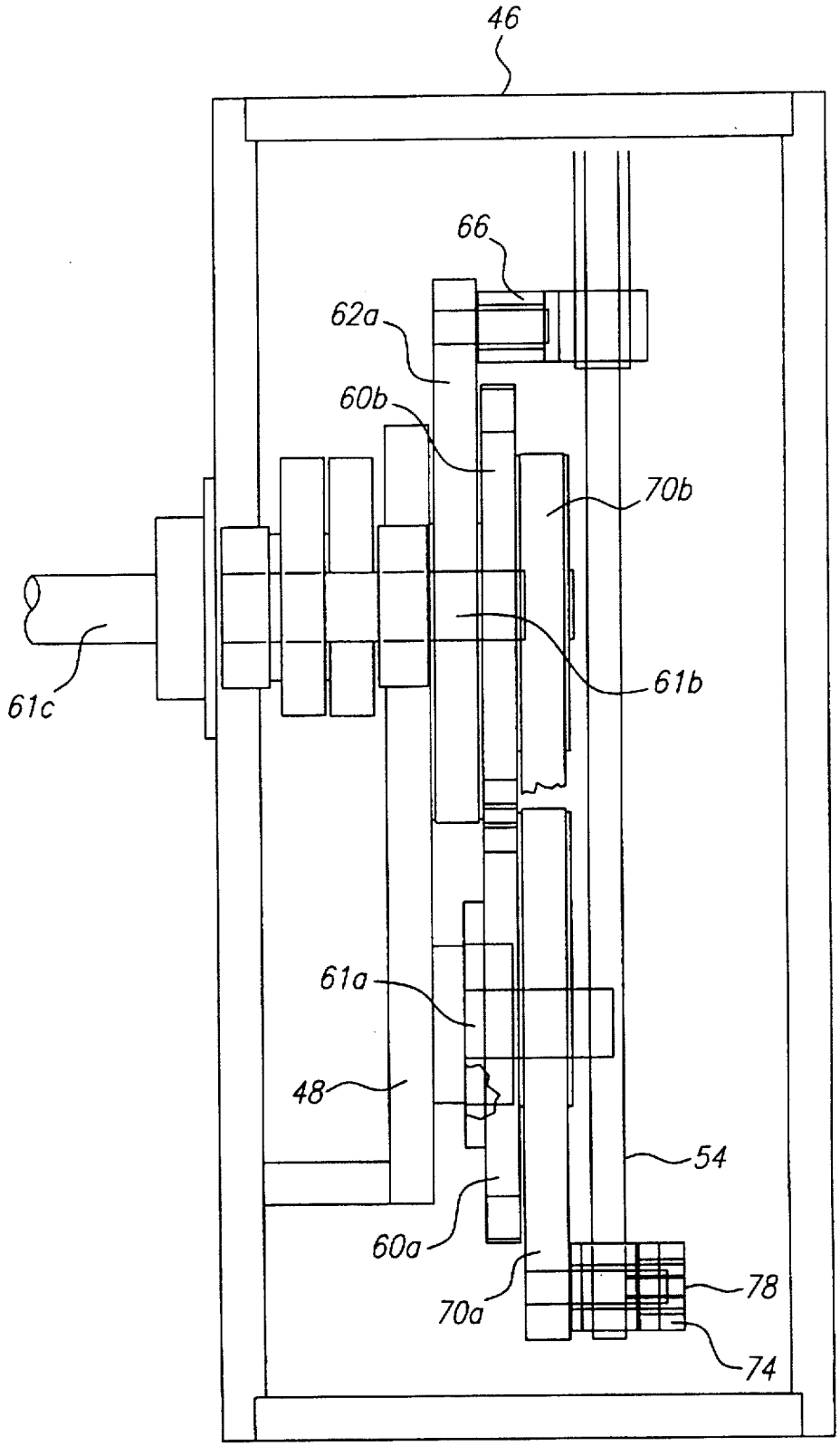
FIG. 5 is a left side view of a drive system.

Referring now to FIGS. 3–5, an embodiment of the current invention is shown in connection with a Beta configured Stirling engine. As discussed later, the current invention is also suitable for use in Gamma and Alpha Stirling engine configurations. FIG. 3 is a front view and FIGS. 4 and 5 are right and left side views respectively.

As shown in FIG. 3, Stirling engine 30 includes cylinder 32 in which displacer piston 34 and power piston 36 reciprocate. In FIG. 3, cylinder 32 has been sectioned away to expose the components contained therein. Control loops 38, which include heat exchanger/coolers 40 serve to alternatingly pass the working fluid or gas between hot (expansion) space 42 and cold (compression) space 44. In FIG. 3, regenerators 40 have also been partially sectioned away.

Cylinder 32 may be mounted to frame 46 which may house drive system 50. Frame 46 may include mounting plate 48 to which various of the components discussed below are attached. Mounting plate 48 may be coupled to frame 46 by bolts, brackets or the like. Displacer piston shaft 54 is attached to displacer piston 34. Power piston shaft 56 is attached to power piston 36. Displacer piston shaft 54 extends through power piston 36 and power piston shaft 56. A suitable seal (not shown) is interposed between displacer shaft 54, and power piston 36 and power piston shaft 56 to prevent leakage of the working fluid or gas.

As discussed above, the displacer piston in existing Stirling engines remains at its bottom dead center position during the power stroke only for an instant. The drive system 50 of the current invention however, provides that displacer piston 34 may be held at its bottom dead center position during the power stroke and at its top dead center position during the compression stroke for increased time intervals. As discussed later, this dwell is essentially achieved by controlling the motion of displacer piston 34 so that it moves in a complex sinusoidal function, i.e., the sum of several sinusoids.

The dwell at the displacer piston's bottom dead center position provides an increase in the work and power output of the Stirling engine 30. This is because more of the force provided by the hot expanding gas as it enters cold space 44 is exerted against power piston 36 instead of being "consumed" or received by the increasing volume of cold space 44 that had been occupied by displacer piston 34 immediately prior. As discussed later, the total amount of dwell per cycle occurring at the top and bottom dead center positions cumulatively, as well as the amount of dwell occurring at each of the top and bottom dead center positions may be adjusted. The components of drive assembly 50 which provide this dwell feature are now described.

Drive assembly 50 may include primary motion gears 60*a*, 60*b* and 60*c* each having teeth which are intermeshed as shown. Alternatively, any type of rotating elements that may interact with each other may be used. Through the various components as described herein, gear 60*a* may be coupled to displacer piston shaft 54, gear 60*b* may be coupled to power piston shaft 56 and gear 60*c* may be coupled to both displacer piston shaft 54 and power piston shaft 56. As more clearly shown in FIGS. 4 and 5, gears 60*a,b* may be connected to mounting plate 48 by shafts 61*a,b* respectively. Gear 60*c* may be connected to mounting plate 48 by shaft 61*c* which itself may also serve as the power output shaft of Stirling engine 30.

As shown, gears 60*a,c* rotate in a clockwise direction while gear 60*b* rotates counterclockwise. For simplicity of design, it is preferred that all three gears 60*a,b,c* have the same diameter which is a function of intended end use load. It is preferred that the centers of gears 60*b,c* lie along the same horizontal plane as shown to simplify the control over the movement of power piston 36.

That portion of drive system 50 which is coupled to power piston 36 is now described. Power journal link 62*a* may be pivotally coupled at its first end to primary motion gear 60*b* at pivot point 63, and power journal link 62*b* may be pivotally coupled at its first end to primary motion gear 60*c* at pivot point 64. Preferably, power journal links 62*a,b* are positioned behind gears 60*b,c* so as to not interfere with other components located ahead of gears 60*b,c*. Also, it is preferred that a portion of power journal links 62*a,b* are cut-out so that shafts 61*b,c* may protrude therethrough to attach gears 60*b,c* to mounting plate 48.

The pivotal attachments between gears 60*b,c* and power journal links 62*a,b* may occur through eccentrics 69 as shown in FIG. 3. To this end, links 62*a,b* may include circular cut-outs at their first ends into which eccentric 69 may be inserted. Alternatively, a shaft and bearing arrangement may be used. Pivot points 63 and 64 are preferably located at the same distance $R_1$, away from the respective centers of gears 60*b,c* to simplify control over the motion of power piston 36. $R_1$ which determines the amplitude of the motion of power piston 36 is a function of intended output power.

Power journal links 62*a,b* preferably extend upwards from pivot points 63,64 so that their second ends may be pivotally coupled to the ends of translating beam yoke 66 at pivot points 67 and 68 respectively. The length of translating beam yoke 66 between pivot points 67,68 may be set equal to the distance between the centers of gears 60*b,c*. The effective length of power journal links 62*a,b*, i.e., distance from pivot point 63 to pivot point 67 and distance from pivot point 64 to pivot point 68, is preferably the same and preferably permits yoke 66 to clear the radius of gears 60*b,c*.

It is also preferred that pivot points 63 and 64 be arranged in similar fashion with respect to the centers of their respective gears 60*b,c*. This is shown in FIG. 3 in that both pivot points 63,64 are located directly below the centers of the gears 60*b,c* respectively at the same time during the motion cycle of power piston 36. Translating beam yoke 66 may be coupled to power shaft 56 as shown, and as such, movement of power piston 36 effects movement of yoke 66, links 62*a,b* and gears 60*b,c*.

The portion of drive system 50 which is coupled to displacer piston 34 is now described. Short displacer journal link 70*a* may be pivotally coupled to primary motion gear 60*a* at pivot point 71 which is at a distance $R_2$ from the center of gear 60*a*. Long displacer journal link 70*b* may be pivotally attached to primary motion gear 60*c* at pivot point 72 which is at a distance $R_3$ from the center of gear 60*c*. In left side view FIG. 5, the upper portion of long displacer journal link 70*b* is shown but this link is then broken away as it disappears from view behind short displacer journal link 70*a*. In right side view FIG. 4, only long link 70*b* is shown as short link 70*a* is completely behind long link 70*b*.

The pivotal attachments between gears 60*a,c* and links 70*a,b* may also occur through eccentrics 69 but once again, a shaft and bearing arrangement may be used. As discussed in connection with dwell adjustment however, it is preferred that long displacer journal link 70*b* be coupled to gear 60*c* through an eccentric 69 that may provide for adjustment of the orientation of link 70*b* relative to gear 60*c*. As shown, displacer journal links 70*a,b* are preferably located before gears 60*a,b* so that they do not interfere with power journal links 62*a,b* upon operation of drive system 50. As also shown, long displacer journal link 70*b* may include a cut-out along its length to decrease its weight. The other links shown in FIG. 3 may also include similar cut-outs.

Displacer journal links 70*a,b* preferably extend downwards as shown, and their second ends mays be pivotally coupled to floating walking beam yoke 74 at pivot points 75 and 76 respectively. Walking beam 74 may be pivotally coupled to displacer shaft 54 at pivot point 78. Pivot point 78 may comprise a shaft and bearing arrangement (not shown). Accordingly, as drive mechanism 50 operates, gears 60*a,c* and displacer journal links 70 drive walking beam 74, which in turn drives displacer shaft 54 and displacer piston 34. As can be seen, it is the position of pivot point 78 that controls the position of displacer shaft 54 and thus displacer piston 34.

To avoid lateral movement of displacer shaft 54 as drive mechanism 50 operates, linear bearing 80 (not shown in FIGS. 4 and 5) may be used to hold displacer shaft 54 in place. However, linear bearing 80 preferably does not interfere with the reciprocating motion of displacer shaft 54. Walking beam 74 is preferably short within the geometric constraints of drive system 50 so that a reduced amount of torque is applied to displacer shaft 54 from the movement of displacer journal links 70.

The operation of drive system 50 is now described. FIG. 3 shows the phase of displacer piston 34 located about 90 degrees ahead of power piston 36. Power piston 36 is at its bottom dead center position and displacer piston 34 is about halfway between its top and bottom dead center positions. This phase relationship is discussed in more detail later.

In any event, the phase relationship remains constant for those portions of the motion cycle where no dwell occurs. However, walking beam 74 allows displacer piston 34 to remain dwelled at its top and/or bottom dead center positions for a specified amount of time while the sinusoidal motion of power piston 36 remains unaffected. Thus during these dwell periods, the phase relationship between displacer piston 34 and power piston 36 changes.

Reference is now made to FIGS. 6*a*–6*l* which depict the motion of displacer shaft 54, power shaft 56, gears 60, power journal links 62, displacer journal links 70 and walking beam 74 as drive mechanism 50 operates through a 360 degree cycle of motion. These figures also show the various pivot points and circles of rotation. FIG. 6*a*–6*l* show the displacer piston 34 leading the power piston 36 by 90 degrees.

In the arrangement shown, displacer shaft 54 (and consequently displacer piston 34) experiences a dwell at both the top and bottom dead center locations. Starting with FIG. 6*a*, power piston 36 is at its bottom dead center location, i.e., at the end of its power stroke, and displacer piston 34 is about halfway between its top and bottom dead center locations. As drive system 50 continues its cycle through FIGS. 6*b* and 6*c*, pivot point 78 between walking beam 74 and displacer shaft 54 generally travels upward because pivot points 71,72 of displacer links 70*a,b* provide a net upward movement. Accordingly, displacer piston 34 travels upward thereby nearing its top dead center location. During this portion of the cycle, power piston 36 is moving upward through its compression stroke.

Figure 6A:
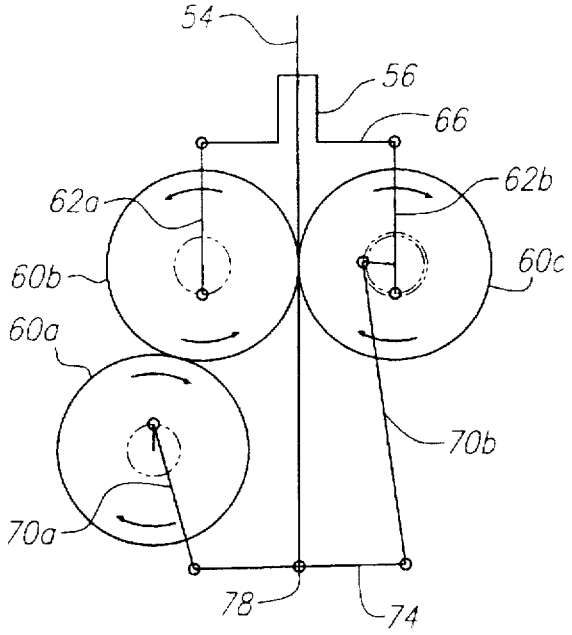
FIGS. 6*a*–6*l* are a sequence of figures which show the sequence of operation of a drive system.
Figure 6B:
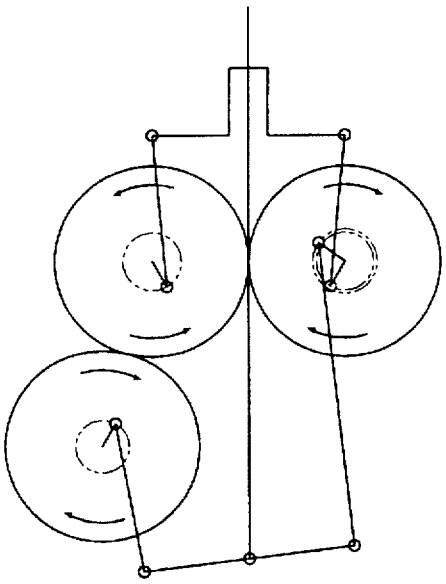
Figure 6C:
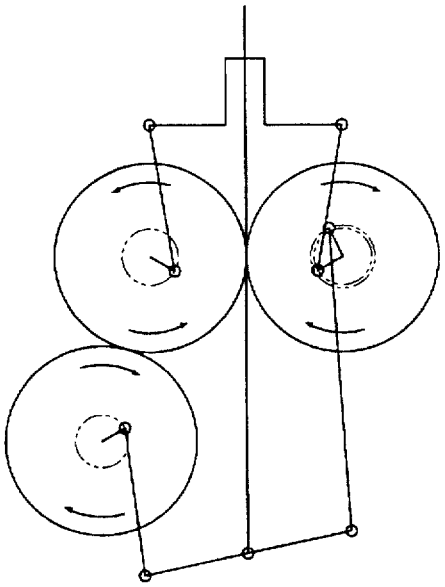
Figure 6D:
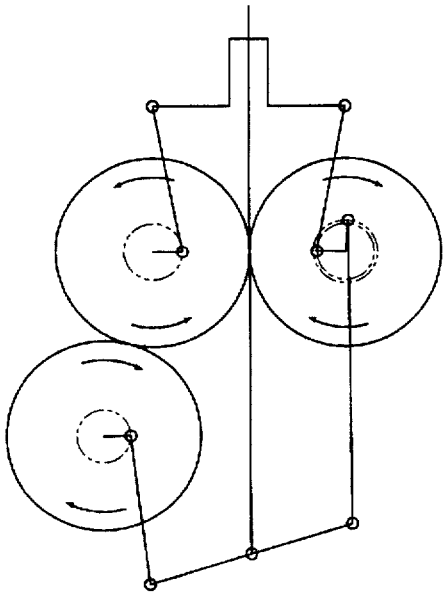
Figure 6E:
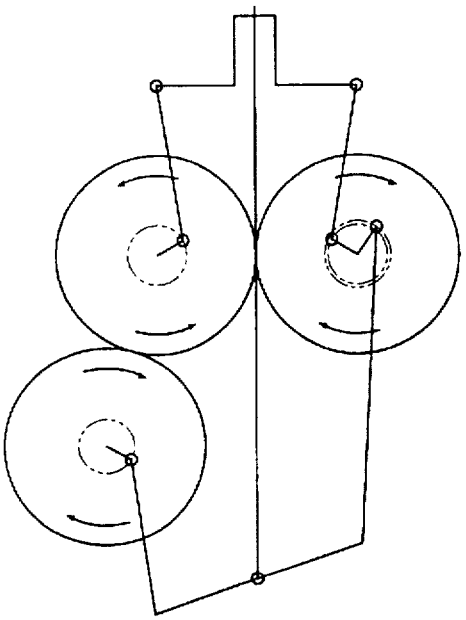
Figure 6F:
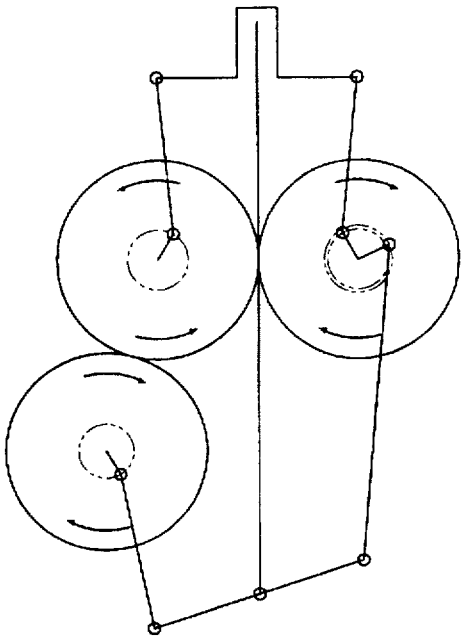
Figure 6G:
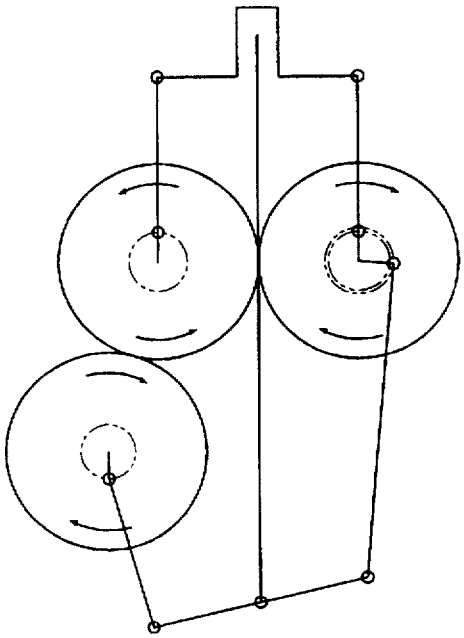
Figure 6H:
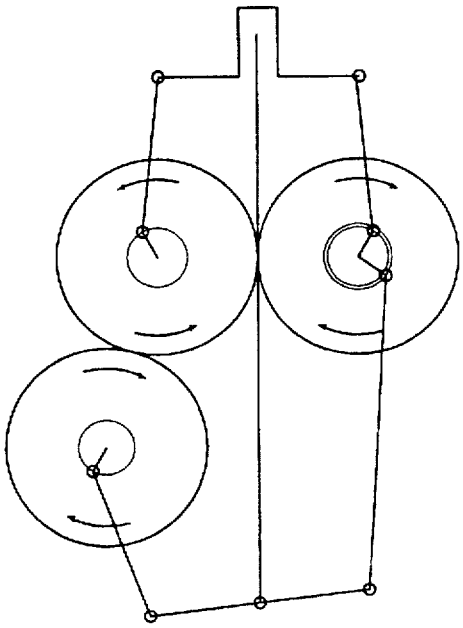
Figure 6I:
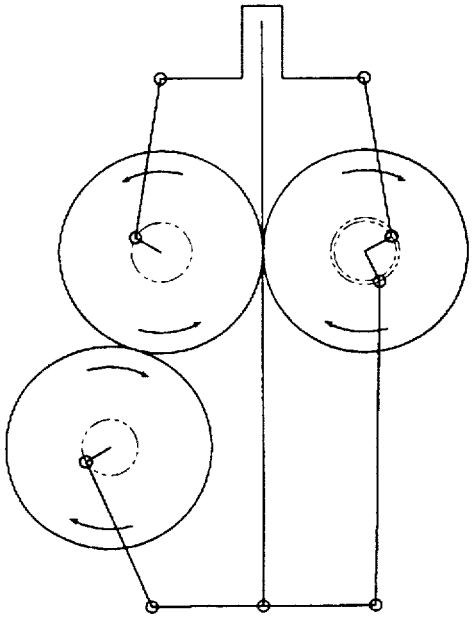
Figure 6J:
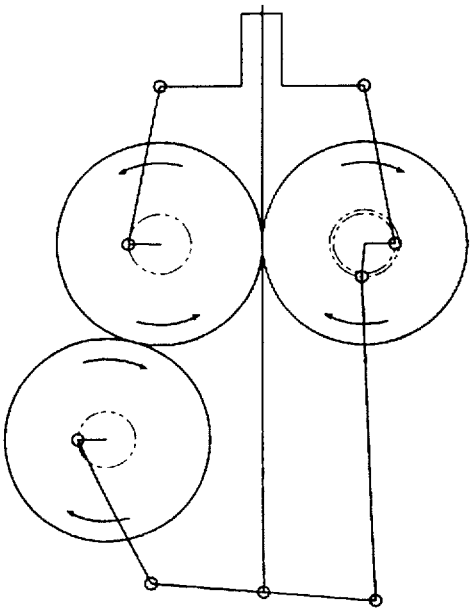

At the portion of the cycle around FIG. 6*d*, displacer piston 34 is dwelled at its top dead center location. This is essentially because pivot point 78 remains at substantially the same vertical position due to the fact that as short displacer journal link 70*a* moves down due to the clockwise motion of gear 60*a*, long displacer journal link 70*b* moves up due to the clockwise motion of gear 60*c*. Thus, the respective vertical motions of links 70*a,b* substantially offset each other and the only motion conveyed to walking beam 74 is substantially one of rotation instead of a net vertical translation. Since this rotation occurs about pivot point 78, displacer shaft 54 and thus displacer piston 34 remains substantially stationary.

During this time, power shaft 56 and thus power piston 36 continue to travel upward on its compression stroke because power journal links 62*a,b* do not offset each other but instead are both undergoing upward vertical motion due to the counterclockwise and clockwise rotation of gears 60*b,c* respectively. Thus the phase relationship between displacer piston 34 and power piston 36 changes during this time.

After displacer piston 34 has dwelled at its top dead center location, and as the cycle proceeds through FIGS. 6*e*–6*i*, both displacer journal links 70*a,b* generally travel downward. Walking beam 74 and thus displacer shaft 54 and displacer piston 34 also travel downward. During this time, power piston 36 continues towards its top dead center which location is reached in FIG. 6g, and then begins its power stroke. Also during this time, the phase between displacer piston 34 and power piston 36 generally remains the same.

At the portion of the cycle around 6j, displacer piston 34 is dwelled at its bottom dead center location. This is essentially because pivot point 78 remains at substantially the same vertical position due to the fact that as short displacer journal link 70a moves up due to the clockwise motion of gear 60a, long displacer journal link 70b moves down due to the clockwise motion of gear 60c. Thus again, the respective vertical motions of links 70a,b substantially offset each other and the only motion conveyed to walking beam 74 is substantially one of rotation instead of a net vertical translation. Displacer shaft 54, and thus displacer piston 34 remain substantially stationary.

As this dwell occurs, power piston 36 continues its power stroke (both power journal links 62a,b continue travelling downward). Accordingly a change in phase again occurs. Because the displacer piston remains at its bottom dead center location however, the force provided by the expanding hot gas in cold space 44 is exerted more acutely on power piston 36, and is less "consumed" by the expansion of cold space 44 (not shown in FIGS. 6a–6l). Accordingly, the power stroke does more work and the Stirling engine 30 outputs more power.

Figure 6K:
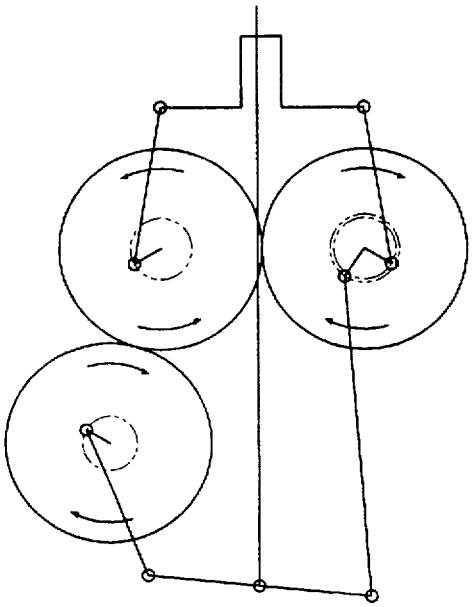
Figure 6L:
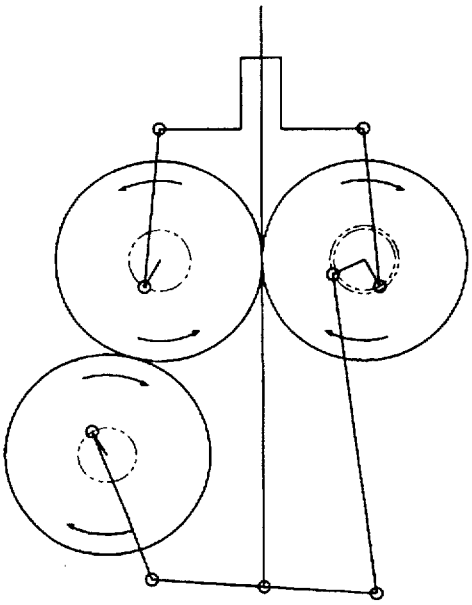

After the dwell occurring at bottom dead center, and as the cycle continues on in FIGS. 6k–6d, both displacer journal links 70a,b travel upward and displacer piston 34 again travels towards its top dead center position as indicated in FIG. 6d. During this time, the phase between displacer piston 34 and power piston 36 again remains the same.

Figures 7A, 7B:
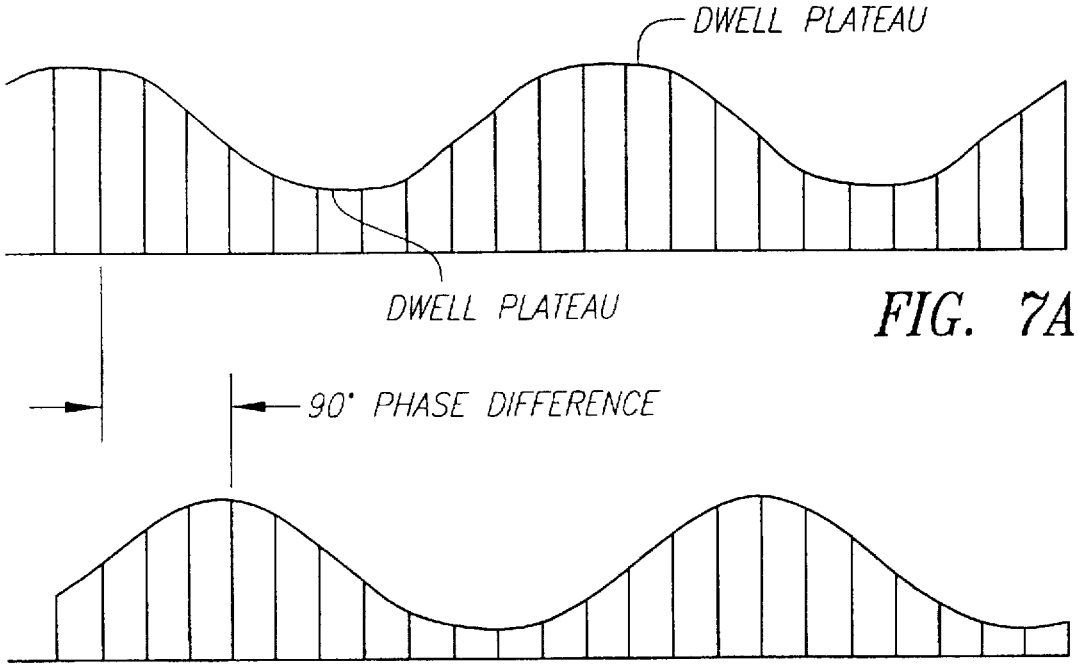
FIG. 7*a* graphically shows the amplitude of the movement of a displacer piston.
FIG. 7*b* graphically shows the amplitude of the movement of a power piston.

Graphical representations of the amplitudes of displacer piston 34 and power piston 36 at thirty degree intervals are shown in FIGS. 7a and 7b respectively. As shown, the phase of displacer piston 34 leads power piston 36 by 90 degrees. The dwell of displacer piston 34 is represented by the flat portions occurring at the amplitude maxima and minima portions of the curve.

Figure 8:
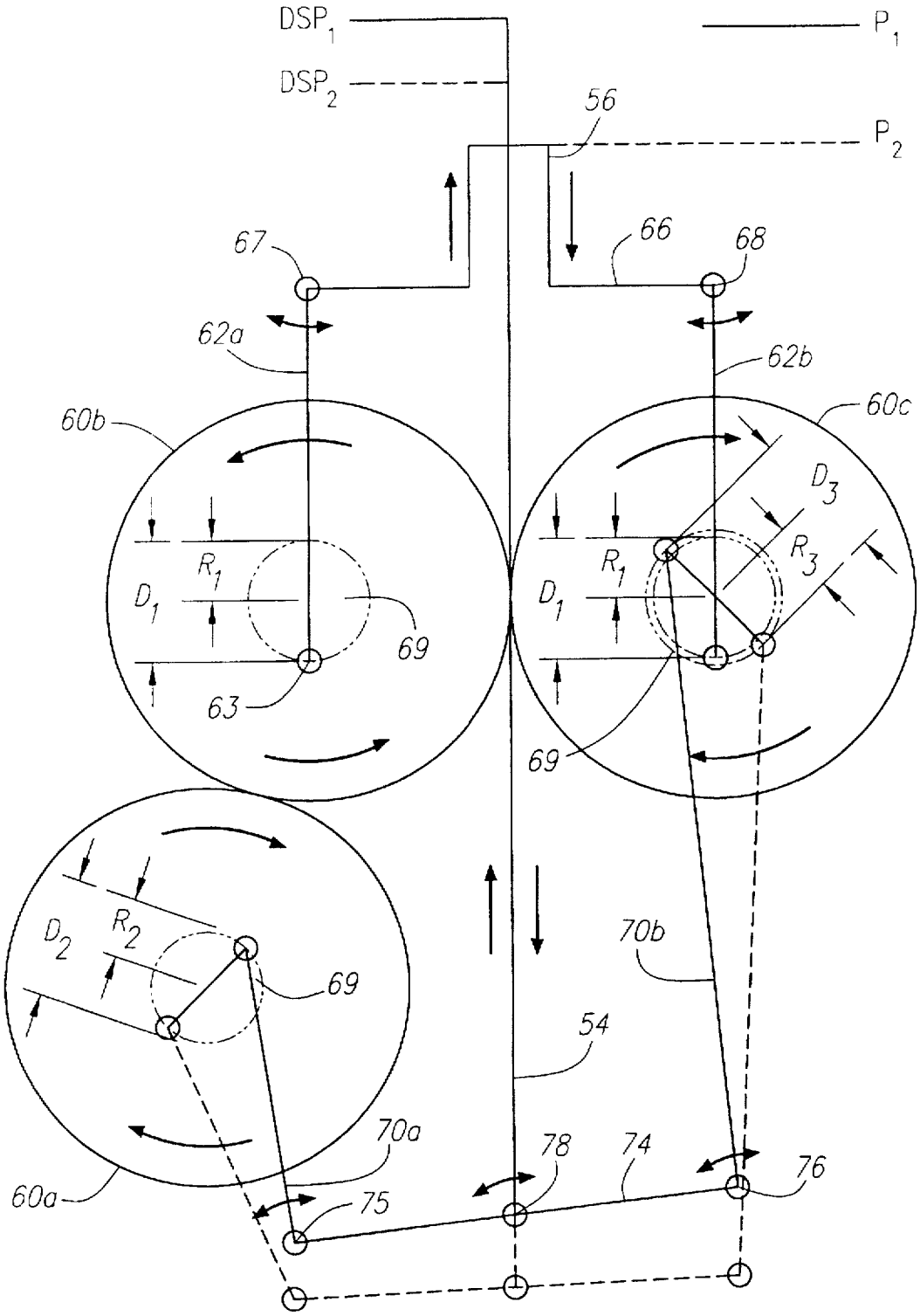
FIG. 8 is a simplified view of a drive system.

Referring to FIG. 8, the geometrical relationships between the various components discussed above and which are responsible for producing the dwell of the current invention are now discussed. FIG. 8 shows displacer links 70a,b and walking beam 74 at two positions during the cycle of operation of drive system 50. The solid lines indicates the point where power piston 34 is at its bottom dead center location and displacer piston is 90 degrees ahead of power piston 34 and is travelling upwards to its top dead center location. This is the configuration shown in FIGS. 3 and 6a. The broken lines show these components at 180 degrees (πradians) later in the cycle.

The dwell of displacer piston 34 is generally related to the respective amplitudes of the motions of power piston 36 and displacer piston 34. The amplitude of power piston 36 motion is equal to twice the rotational radius $R_1$, i.e., twice the distance between the centers of primary motion gears 60b,c and pivot points 63,64 respectively. This distance is $D_1$ in FIG. 8, i.e., twice the distance of $R_1$, and the circle of rotation having a diameter $D_1$ is shown. As indicated above, it is preferred that power journal links 62a,b be coupled to their respective gears 60b,c in similar fashion. This is because the amplitude of power piston 36 is thereby more easily controlled.

The amplitude and motion characteristics of displacer piston 34 are generally more complex and depend on factors including the following: (1) the distance $R_2$ and $R_3$ as shown in FIG. 3, (2) the center-to-center distance between primary motion gears 60a,b,c, (3) the length of displacer journal links 70a,b and (4) the relationship between the pivot points at either end of walking beam yoke 74, and pivot point 78.

Because pivot points 71,72 of displacer journal links 70a,b are located at different off-center locations relative to each other on gears 60a,c respectively, displacer journal links 70a,b move in asynchronous fashion. To this end, it should be noted that the pivot point 71 of short displacer journal link 70a is located a distance $R_2$ away from the center of gear 60a, which is shorter than the distance $R_3$ between pivot point 72 of long displacer journal link 70b and the center of gear 60c. Thus the circle of rotation of pivot point 71 having a diameter $D_2$ is smaller than the circle of rotation of pivot point 72 having a diameter $D_3$. These circles of rotation are shown in FIG. 8.

The aforesaid asynchronous motion of displacer journal links 70a,b provides for control and manipulation of relative dwell, duration of dwell, location and stroke amplitude of displacer piston 34. The asynchronous motion of displacer journal links 70a,b also serves to change the phase angle ϕ between displacer piston 34 and power piston 36 during the dwell portions of the cycle of drive system 50.

One relationship with respect to the foregoing parameters is tied to the sine of the phase angle ϕ between displacer piston 34 and power piston 36. Assuming that $D_3$ and $D_2$ are the larger and smaller circles of rotation of displacer journal links 70a,b as defined in FIG. 8, the empirical relationship between the various variables to the amplitude of displacer piston 34 is of the following nature:

$$[(A*D_3*\sin(\phi)+B*D_2*\sin(\phi))*0.5]+C*D_2\sin(\theta)=\text{amplitude of Displacer Piston}$$

In this relationship, A, B and C are scalar constants that may be determined analytically or experimentally and the angle θ is the angle between the longitudinal axis of walking beam 74 and horizontal. In view of the foregoing relationship, the relative diameters ($D_3$ and $D_2$) may be varied to optimize the performance of Stirling engine 30, as may be the phase angle θ between displacer piston 34 and power piston. In any event, the following relationships may be written.

$$[(A*D_3*\sin(\phi)+B*D_2*\sin(\phi))*0.5]+C*D_2\sin(\theta)=\text{amplitude of Displacer Piston}$$

$$[(A*D_3+B*D_2)*\sin(\phi)*0.5]+C*D_2\sin(\theta)=\text{amplitude of Displacer Piston}$$

If the angle θ, i.e., the angle between the longitudinal axis of walking beam 74 and a horizontal line, is zero, the following relationship may apply:

$$(D_3*0.5+D_2*0.5)*\sin(\phi)=\text{amplitude of Displacer Piston}$$

Or, in this case of drive system 50 shown in FIG. 3, $$(D_3*0.5+D_2*0.5)*\sin(\phi)=1.4$$

The above relationship may be rewritten as follows.

$$(D_3+D_2)*\sin(\phi)=2.8,\ \text{where } \phi \text{ ranges from } 75° \text{ to } 90°$$

Thus it is seen that the system is described by an equation with three variables and a target amplitude. The system equation may be solved mechanically, iteratively or graphically. Doing so results in a functional representation of drive system 50 as shown in the sequence of FIGS. 6a through 6l discussed above.

Figure 9:
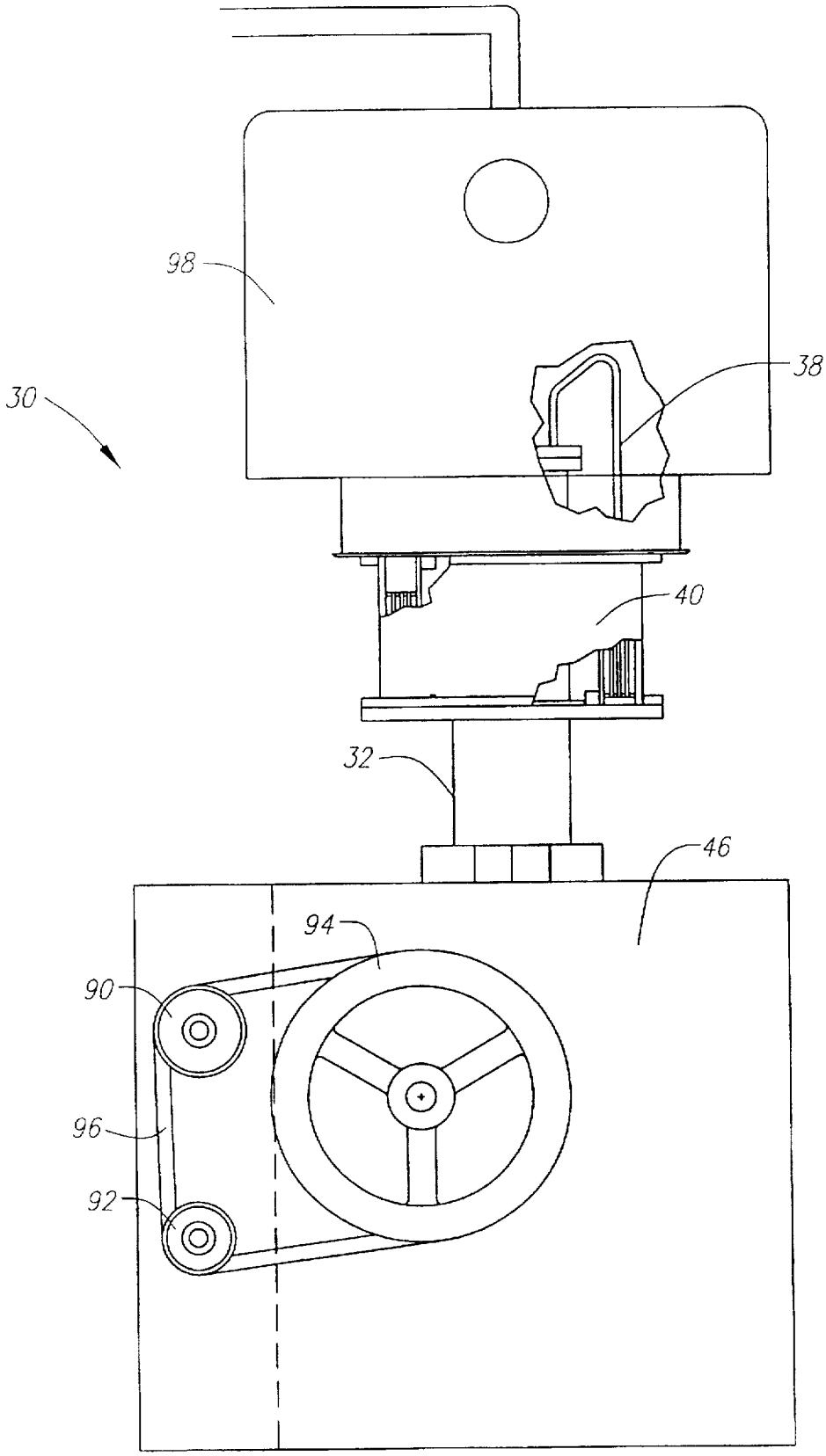
FIG. 9 illustrates an overall system for a Stirling engine.

Now that the operation of drive system 50 has been described, the overall operation of Stirling engine 30 is discussed with reference to FIG. 9. As shown, starter motor 90, water pump 92 and flywheel 94 may be rotatably mounted to frame 46 by suitable shafts (not shown). It should be noted that FIG. 9 shows the pullies associated with starter motor 90 and water pump 92 that drive these components. Flywheel 94 however, is preferably coupled to power output shaft 61*c* and is thus coupled to gear 60*c*. Starter motor 90, cooling pump 92 and flywheel 94 preferably communicate with each other via belt 96.

When starting Stirling engine 30, heater 98 is activated to heat the working fluid or gas. In FIG. 9, heater 98 is partially broken away to show working fluid control loop 38 and heat exchanger/cooler 40. Starter motor 90 may then be activated which serves to rotate cooling pump 92 and flywheel 94. Cooling pump 92 pumps a cooling fluid to cooler 40 to cool the working fluid or gas as it enters cold (compression) space 44 between displacer piston 34 and power piston 36. In an automotive application, cooling pump 92 may pump a cooling fluid through the radiator of the vehicle, which cooled fluid is then passed to the cooler 40.

The rotation of flywheel 94 rotates gear 60*c* which in turn rotates gear 60*b* and 60*a*. Rotation of gears 60*a,b,c* ultimately starts the operation of the entire drive system 50 and thus starts the Stirling cycle of engine 30. That is, power beam yoke 66 and walking beam 74 move in response to the rotation of gears 60 which in turn reciprocates power piston 36 and displacer piston 34 respectively. As this occurs, the working fluid or gas begins to be alternatingly transmitted between hot end 42 and cold end 44 through control loop 38. The consequent expansion and contraction of the working fluid or gas then provides the force necessary to perpetuate the cycle of drive mechanism 50.

As drive mechanism 50 operates, the power produced thereby is transmitted through power output shaft 61*c* which may then provide power as necessary. For example, output power shaft 61*c* may be coupled to an automobile axle or transmission. And because displacer piston 34 is dwelled as described above, this power output is increased over existing Stirling engines.

Adjustment of the dwell of displacer piston 34 is now discussed with reference to FIGS. 10*a*–10*f*. As shown, dwell adjustment generally occurs by varying the angles of orientation of displacer journal links 70*a,b* in relation to their respective centers of gears 60*a,c*.

Figure 10A:
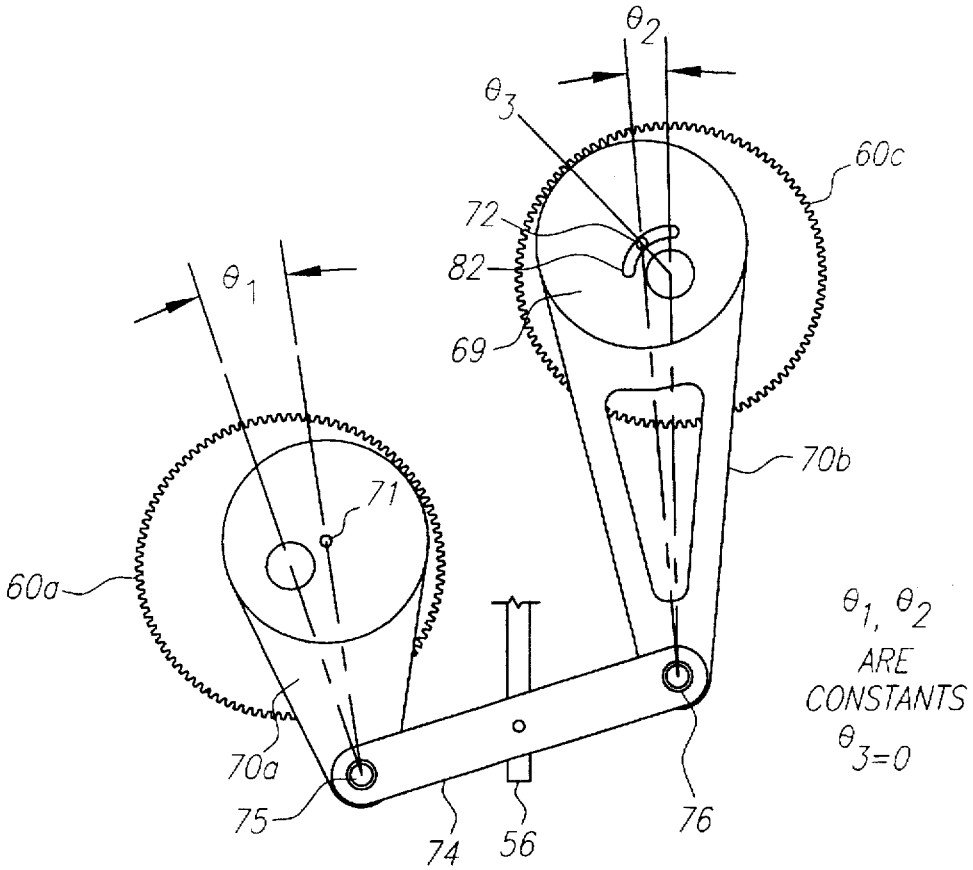
FIGS. 10*a,c* and *e* show varying configurations of a drive system to vary the dwell of a displacer piston.

In FIG. 10*a*, short displacer journal link 70*a* is oriented at an angle $\theta_1$. As shown, $\theta_1$ is the angle formed by the distance between the center of gear 60*a* and pivot point 71 in relation to pivot point 75. Long displacer journal link 70*b* is oriented at an angle $\theta_2$ formed by the distance between pivot point 72 and the center of gear 60*c* in relation to pivot point 76. $\theta_3$, which serves as a reference point, is zero degrees.

Figure 10B:
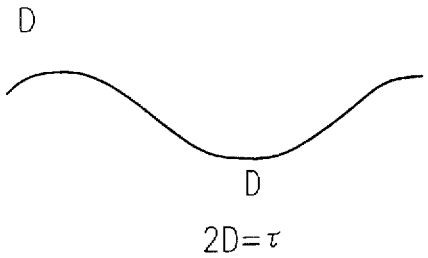
FIGS. 10*b,d* and *f* graphically show the relative amounts of dwell occurring at top and bottom dead center as a result of the configurations shown in FIGS. 10*a,c* and e, respectively.

In this configuration, which is similar to that shown in FIG. 3, an equal amount of dwell D occurs at the top and bottom dead center locations of displacer piston 34 as graphically shown in FIG. 10*b*. The dwell D occurring at each location is about 37 degrees, and the cumulative dwell T occurring at top and bottom dead centers, which is the total amount of dwell provided by drive system 50, is thus about 74 degrees.

Figure 10C:
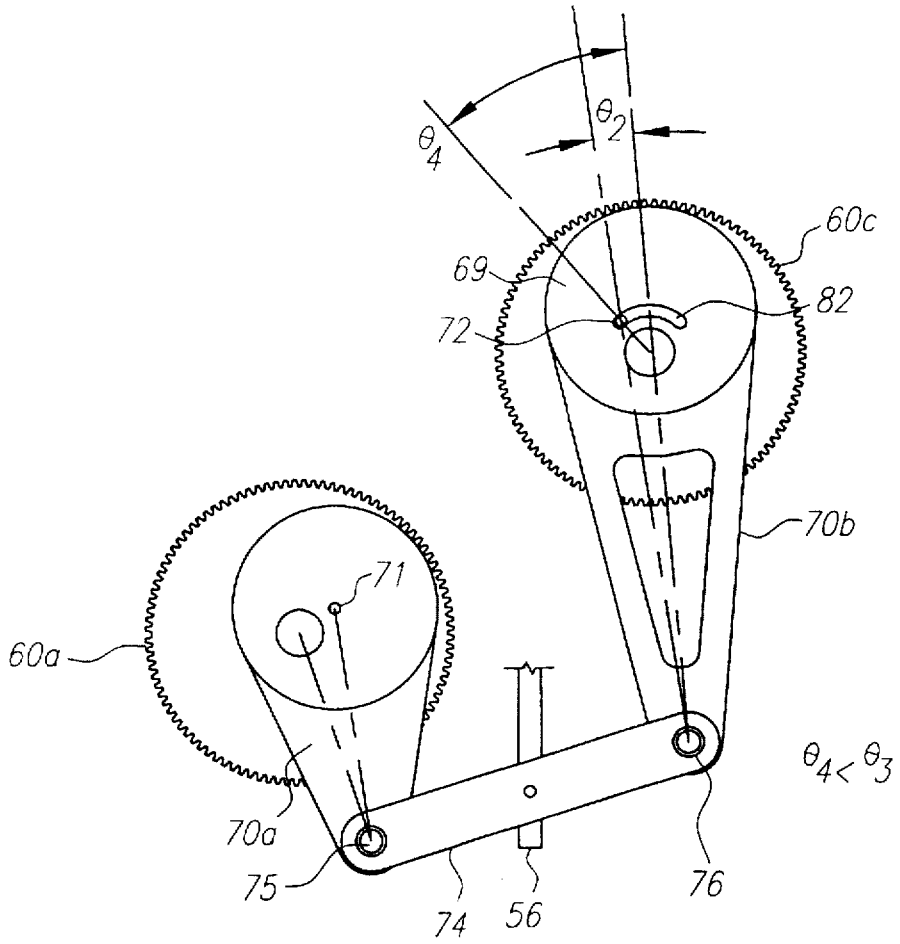
Figure 10D:
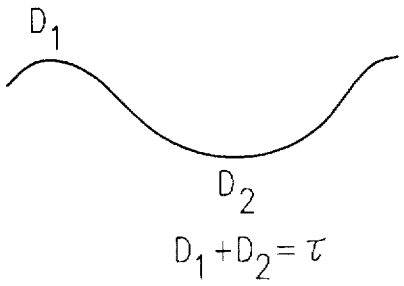

In FIG. 10*c*, the position of long displacer link 70*b* has been changed by positioning it at one end of cut-out 82 such that it is oriented at an angle $\theta_4$ which is smaller than, i.e., negative with relation to, $\theta_3$. The orientation of short displacer link 70*a* has remained the same. Where displacer link 70*b* is oriented at $\theta_4$, the amount of dwell $D_2$ occurring at the bottom dead center location of displacer piston 34 motion is increased while the amount of dwell $D_1$ occurring at the top dead center location of displacer piston 34 motion is decreased as graphically shown in FIG. 10*d*. The total amount of dwell T cumulatively provided at top and bottom dead centers remains the same, however.

Increasing the dwell at the bottom dead center location of displacer piston 34 is advantageous in that the force provided by the hot expanding gas entering cold space 44 is exerted against power piston 36 during its power stroke is increased. That is, less force is "consumed" by the expansion of cold space 44 and the force is exerted against power piston 36 for a longer period time thereby increasing the power output of Stirling engine 30.

Another advantage of increasing the dwell at the bottom dead center location is related to the relative efficiencies of the heating and cooling mechanisms of control loop 38. That is, where the heating mechanism may not be as efficient as the cooling mechanism, more time to heat the working fluid as it enters hot end 42 of cylinder 32 may be necessary. Accordingly, providing more dwell at bottom dead center provides more time for sufficient heating to occur because a longer amount of time will be required for displacer piston 34 to return back to top dead center at hot end 42. While it might appear that most or all of the dwell provided by drive system 50 should occur at bottom dead center, the maximum allowable amount of dwell occurring at bottom dead center may be restricted in view of the dimensional and geometrical constraints posed by the various component of drive system 50.

Figure 10E:
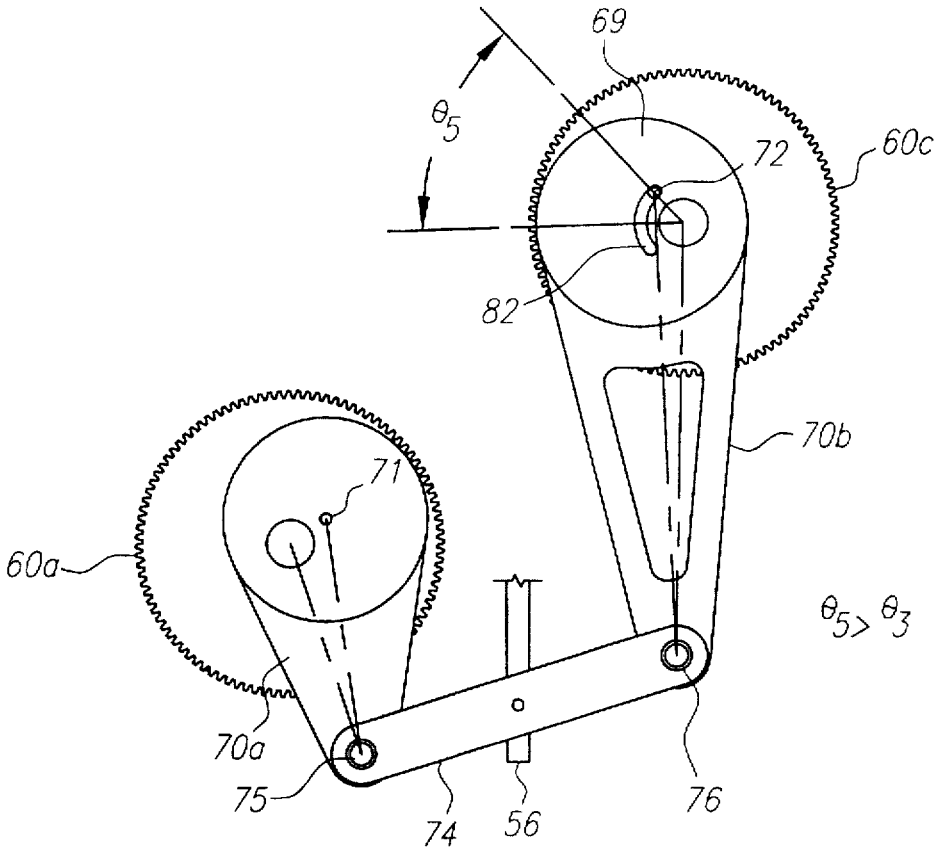
Figure 10F:
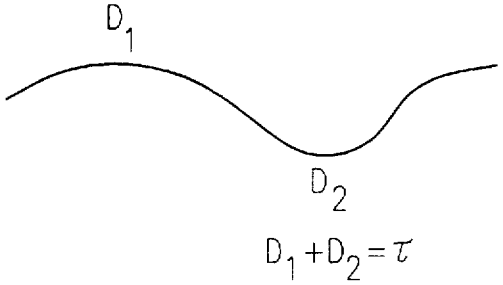

In FIG. 10*e*, the position of long displacer link 70*b* has been changed to the other end of cut-out 82 such that it is oriented at an angle $\theta_5$ which is larger than, i.e., positive with relation to, $\theta_3$. The orientation of short displacer link 70*a* has remained the same. Where displacer link 70*b* is oriented at $\theta_5$, the amount of dwell $D_2$ occurring at the bottom dead center location of displacer piston 34 motion is decreased while the amount of dwell $D_1$ occurring at the top dead center location of displacer piston 34 motion is increased as graphically shown in FIG. 10*d*. The total amount of dwell T cumulatively provided at top and bottom dead center locations again remains the same. It may be advantageous to increase the dwell at the top dead center location where the cooling mechanism of Stirling engine 30 is less efficient than the heating mechanism. In this manner, more time is provided for the working fluid or gas to cool after entering cold space 44 of cylinder 32 because displacer piston 34 will require more time to return to cold end 44.

To change its orientation, long displacer journal link 70*b* may include a circular cutout at its upper end that may accommodate a correspondingly circular eccentric 69. The eccentric is in turn attached to gear 60*c*. The eccentric may include an arcuate cutout 82, the arc of which preferably does not match the arc of the perimeter of gear 60*c*. Arcuate cutout 82 may accommodate a pin extending outward from gear 60*c*. By rotating eccentric 69 along arc 82, the effective orientation of long displacer journal link 70*b* is changed, thereby changing the angle and the associated dwell occurring at the top and bottom dead center locations.

The dwell of displacer piston 34 may also be varied by changing the orientation of short displacer journal link 70*a* while leaving the orientation of long displacer journal link 70*b* the same. Furthermore, the total amount of dwell time T may be varied by changing the orientation of both displacer links The setting and adjustment of the phase angle $\phi$ between displacer piston 34 and power piston 36 is now described with reference to FIG. 8. The phase angle $\phi$ between displacer piston 34 and power piston 36 is generally a function of the relationship between gears 60. If eccentrics 69 are used in cutouts of the various links 62,70, the position of eccentrics 69 also affects the phase angle $\phi$. Thus the phase angle $\phi$ may generally be changed by simply rotating one of gears 60 relative to another thereby changing which teeth are intermeshed.

To arrive at a phase angle $\phi$ where displacer piston 34 leads power piston by 90 degrees, the top and bottom points of the cycle of power piston 36 may be determined by rotating gears 60*b,c* through one revolution of travel. Alternatively, power piston 36 amplitude is generally equal to twice the distance between the centers of gears 60*b,c* to the respective pivot points 63,64. The top and bottom points of power piston 36 are shown graphically on FIG. 8 as $P_1$ and $P_2$ respectively.

The top and bottom points of the cycle of displacer piston 34 may then be determined by rotating gears 60*a,b,c* through a revolution of travel, which points are graphically shown as $DSP_1$ and $DSP_2$ respectively. Alternatively, because the lengths of displacer links 70*a,b* and walking beam 74 are constant, the amplitude may be determined as discussed earlier. After these amplitudes have been determined, to set the phase of displacer piston 34 ahead of the phase of power piston 36 by 90 degrees, gears 60 may be adjusted relative to each other, or eccentrics 69 may be adjusted, so that the midpoint between the $DSP_1$ and $DSP_2$ locations is at the top point of power piston 36 travel, i.e., point P1.

It is preferred that any such phase angle $\phi$ change be effected between gears 60*a,b*. This is because these gears are associated with only one of the displacer and power link journals while gear 60*c* is associated with both. Such adjustments may also generally vary the stroke of displacer piston 34.

Figure 11:
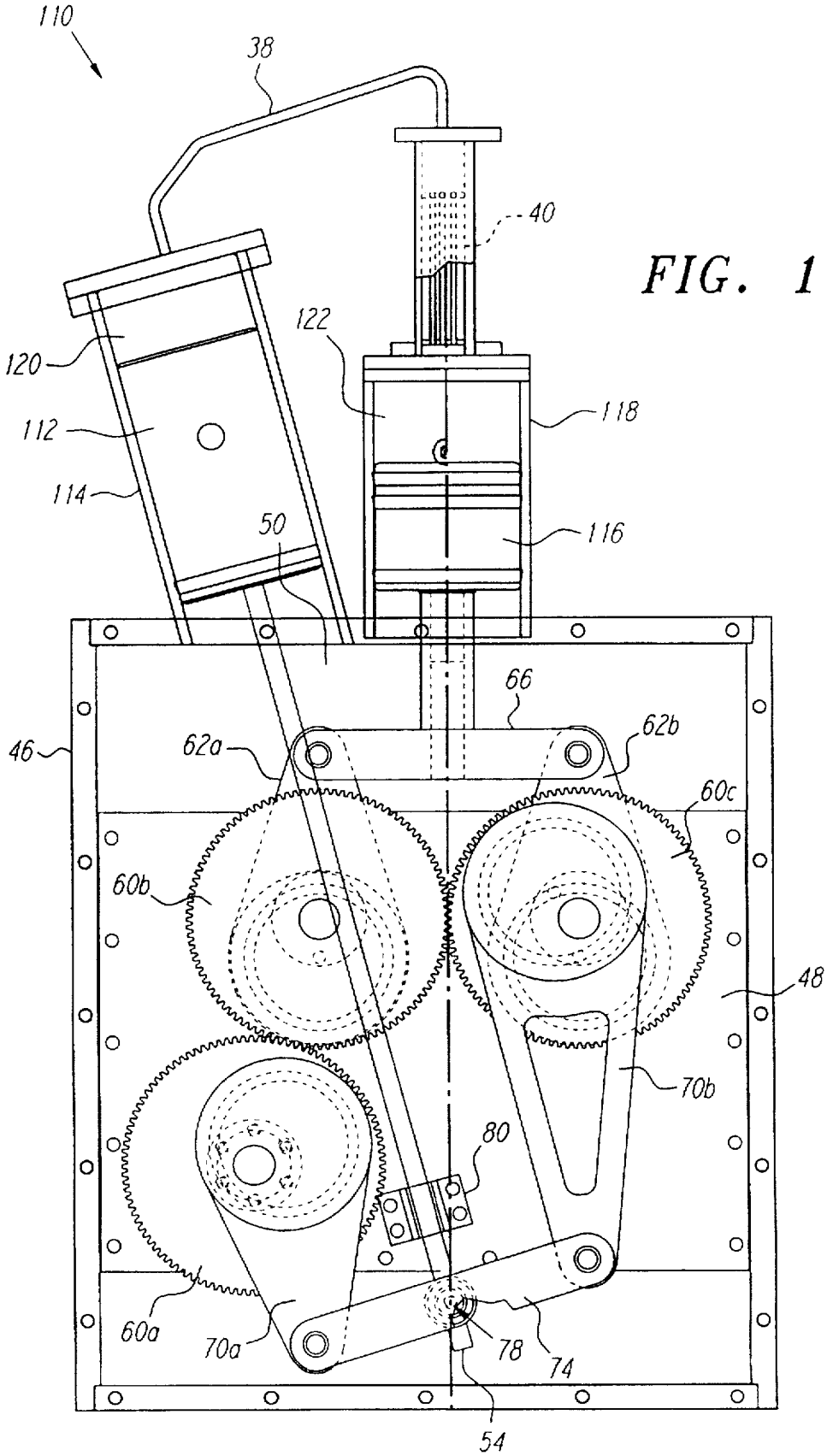
FIG. 11 shows a drive system for use in an Alpha configuration Stirling engine.
Figure 12:
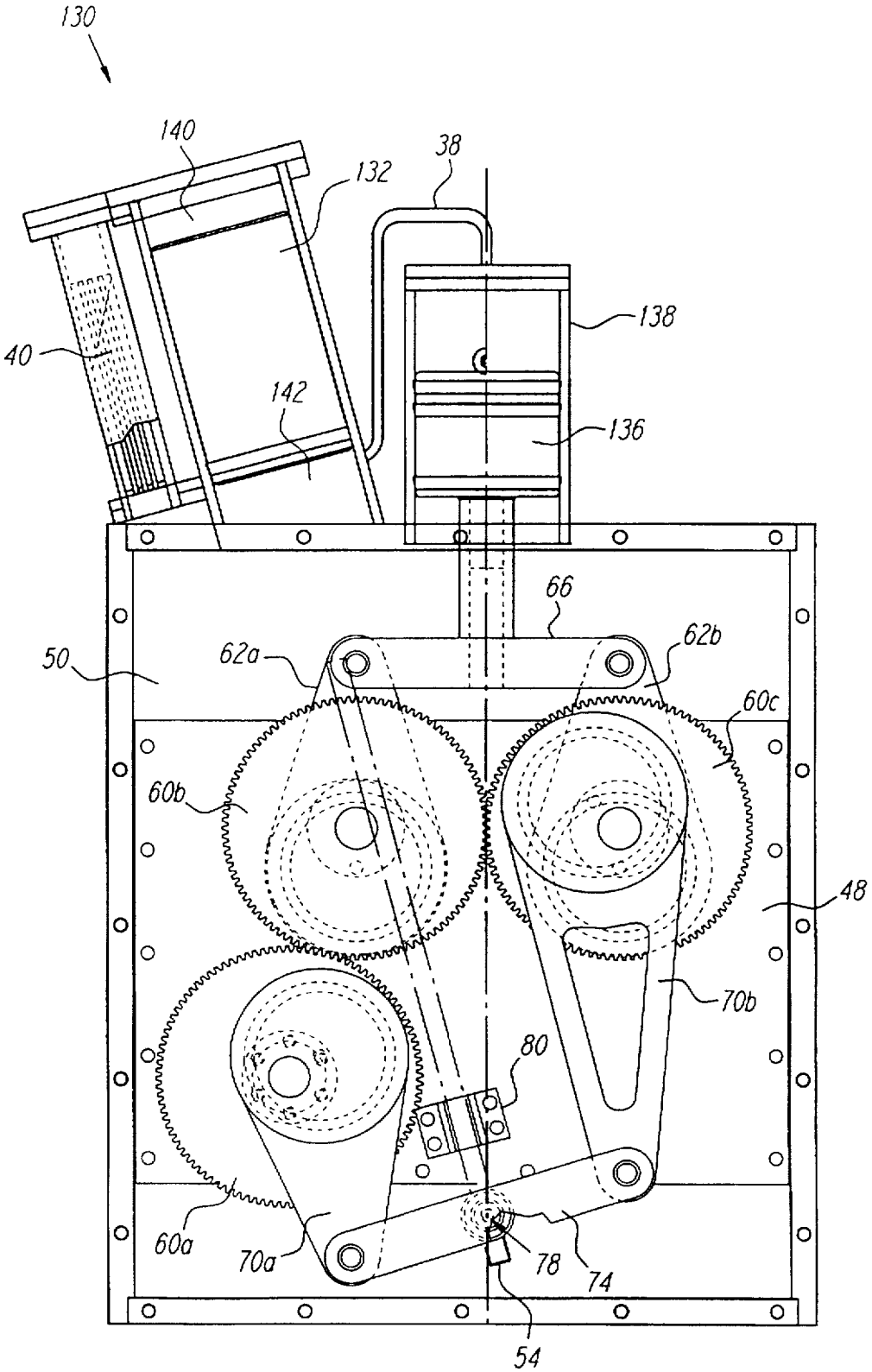
FIG. 12 shows a drive system for use in a Gamma configuration Stirling engine.

Referring now to FIGS. 11 and 12, drive system 50 is shown in connection with Alpha and Gamma configuration Stirling engines, respectively. In FIG. 11, Alpha configured Stirling engine 110 may include components similar to those of drive system 50 shown in FIG. 3, which components are referenced by similar numerals.

The primary difference between Alpha Stirling engine 110 and Beta Stirling engine 30 is that the displacer and power pistons are not housed by the same cylinder. Instead, displacer piston 112 is housed in cylinder 114 and power piston 116 is housed in cylinder 118. Cylinder 112 includes cold space 120 and cylinder 118 includes hot space 122. To accommodate the cylinders 112,118, displacer shaft 54 extends at an angle from walking beam 74 to displacer piston 34. Linear bearing 80 is thus coupled to mounting plate 48 at the location shown to accommodate this angle.

In Alpha Stirling engine 110, it is generally the case that the stroke of displacer piston 112 is longer than the stroke of displacer piston 34 in Beta Stirling engine 30. This is generally because there is typically a longer distance over which the working fluid or gas must travel when alternating between hot space 122 and cold space 120.

Referring to FIG. 12, Gamma configured Stirling engine 130 is shown where like elements are similarly numbered. Here, displacer piston 132 is housed by displacer cylinder 134 and power piston 136 is housed by power cylinder 138. Cylinder 132 includes cold space 140 and hot space 142. To accommodate cylinders 134,138, displacer shaft 54 may again extend at an angle, and linear bearing 80 is mounted to mounted plate 48 accordingly.

Figure 13:
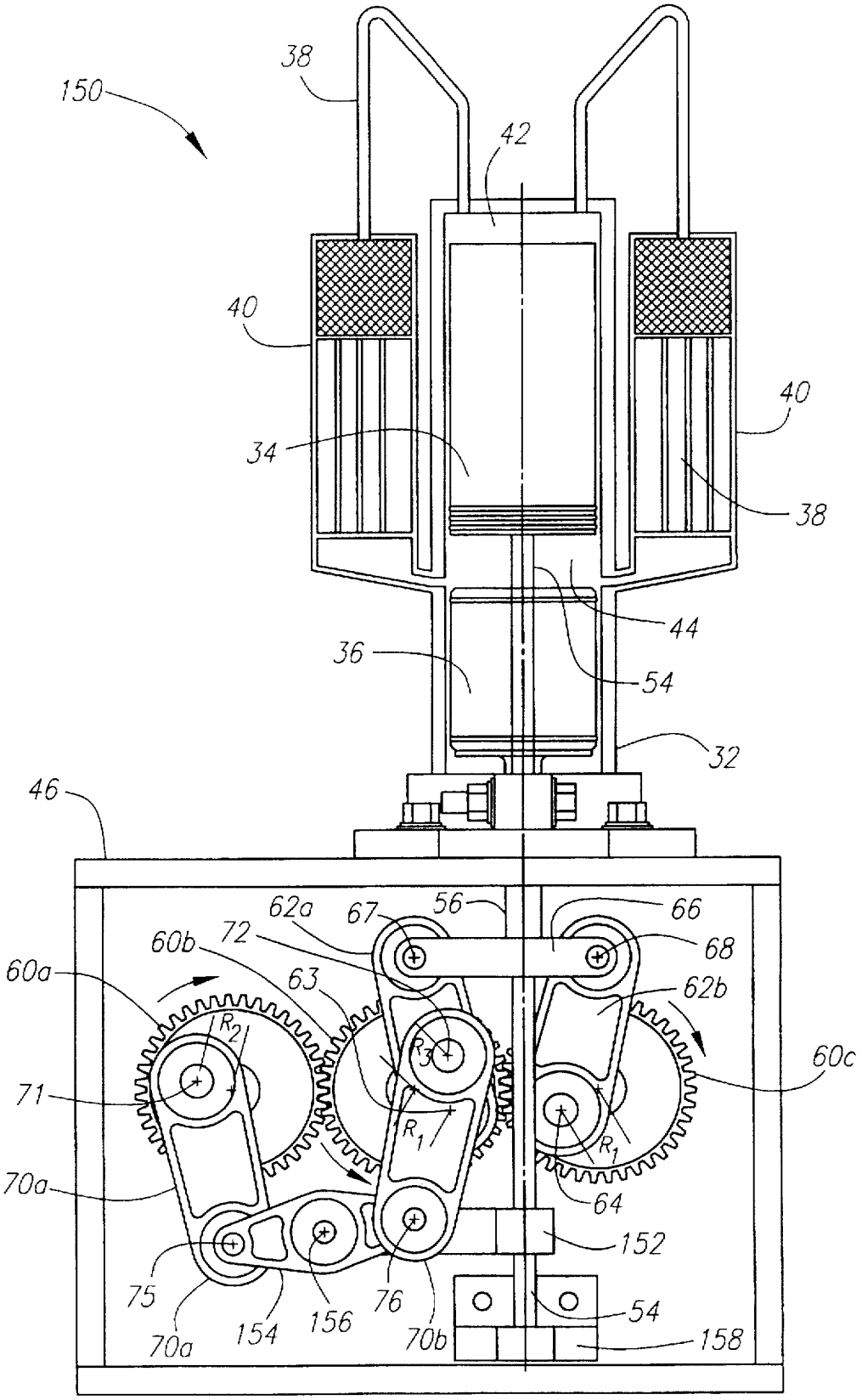
FIG. 13 shows an alternate drive system in a Beta configuration Stirling engine.

Referring to FIG. 13, an alternate configuration of drive system 50 is shown in connection with a Beta configured Stirling engine 148. Like components are similarly numbered as those in previous embodiments. The primary difference between drive system 150 and drive system 50 of Beta Stirling engine 30 in FIG. 3 is that gears 60 are aligned on the same horizonal plane. Furthermore, displacer link journals 70 may be the same length. In this embodiment, displacer arm 152 is fixedly attached to displacer shaft 54 as shown. Displacer arm 152 extends toward walking beam 154 and is pivotally coupled thereto at pivot point 156. Accordingly, the dwell at top and/or dead bottom centers occurs as walking beam 154 rotates about pivot point 156.

To avoid lateral movement of displacer shaft 54, linear bearing 158 may be installed near the end of displacer shaft 54. Linear bearing 158 allows reciprocating movement of displacer shaft 54. Dwell and phase angle may be adjusted in similar manner as described above.

Numerous additional variations and modifications of the present invention are possible in light of the above teachings. For example, the dimensions of the various gears and links, and the distances between pivot points alter the dwell of drive system 50 accordingly. It is therefore to be understood that, within the scope of the appended claims, the invention may be practiced otherwise than as specifically described herein.

What is claimed is:

1. A Stirling engine including a displacer piston and a power piston, comprising:

a drive system coupling the displacer piston and power piston, the drive system having a floating yoke member coupled to the displacer piston, the yoke configured to provide a dwell at both top dead center and bottom dead center in a stroke of the displacer piston.

2. The Stirling engine of claim 1, the drive system further comprising adjustable linkages to vary a phase angle between the displacer piston and power piston.

3. The Stirling engine of claim 1, further comprising a drive shaft driven via motion of the power piston; and a single cylinder in which both the power piston and the displacer piston reciprocate, wherein motion of the power piston acting on the drive shaft is independent from motion of any other power piston of the Stirling engine.

4. The Stirling engine of claim 1, the drive system further comprising adjustable linkages to vary amount of dwell provided.

5. A Stirling engine comprising:

a displacer piston;

a power piston; and a drive system including linkages for coupling the displacer piston and power piston, the drive system providing a dwell in a stroke of the displacer piston, wherein linkages are adjustable to vary the total amount of dwell provided.

6. The Stirling engine of claim 5, the drive system further comprising adjustable linkages to vary a phase angle between the displacer piston and power piston.

7. A Stirling engine comprising:

a displacer piston;

a power piston; and a drive system coupling the displacer piston and the power piston, the drive system providing a dwell at both the top dead center and bottom dead center in a stroke of the displacer piston, the drive system including:

a yoke coupled to the displacer piston;

at least one rotatable element;

at least one power link having a first end directly coupled to the at least one rotatable element and a second end coupled to the power piston; and at least one displacer link having a first end directly coupled to the at least one rotatable element and a second end coupled to the yoke.

8. A Stirling engine comprising:

a displacer piston;

a power piston;

a drive system including linkages for coupling the displacer piston and power piston, the drive system providing a dwell at both top dead center and bottom dead center in a stroke of the displacer piston;

a first cylinder in which the power piston reciprocates; and a second cylinder in which the displacer cylinder reciprocates, the first and second cylinders being arranged in parallel.

9. A Stirling engine comprising:

a displacer piston;

a power piston;

a drive system including linkages for coupling the displacer piston and power piston, the drive system providing a dwell at both top dead center and bottom dead center in a stroke of the displacer piston;

a first cylinder in which the power piston reciprocates; and a second cylinder in which the displacer piston reciprocates, the first and second cylinders being arranged offset from one another.

10. A drive system for a Stirling engine, the Stirling engine including a displacer piston and a power piston, the drive system comprising:

a linkage adapted to couple the displacer piston and power piston, the linkage having a floating yoke member coupled to the displacer piston, the yoke configured to provide a dwell at both the top dead center and bottom dead center in a stroke of the displacer piston.

11. The drive system of claim 10, further comprising adjustable linkages to vary a phase angle of the Stirling engine.

12. The drive system of claim 10, further comprising adjustable linkages to vary amount of dwell provided.

13. A drive system for a Stirling engine, the Stirling engine including a displacer piston and a power piston, the drive system comprising:

a linkage adapted to couple the displacer piston and power piston, the linkage configured to provide a dwell at both the top dead center and bottom dead center in a stroke of the displacer piston, the linkage further comprising:

a yoke;

at least one rotatable element;

at least one power link having a first end directly coupled to the at least one rotatable element; and at least one displacer link having a first end directly coupled to the at least one rotatable element and a second end coupled to the yoke.

14. A drive system for a Stirling engine, the Stirling engine including a displacer piston and a power piston, the drive system comprising:

a linkage adapted to couple the displacer piston and power piston, the linkage configured to provide a dwell in a stroke of the displacer piston, the linkage being adjustable to vary the total amount of dwell provided.

15. The drive system of claim 14, further comprising adjustable linkages to vary a phase angle of the Stirling engine.

16. A Stirling engine comprising:

a displacer piston;

a power piston;

first, second and third rotatable elements adapted to interact with each other;

a first power link having a first end pivotally coupled to the second rotatable element;

a second power link having a first end pivotally coupled to the third rotatable element;

a power beam coupled to the power piston and pivotally coupled to second ends of the first and second power links;

a first displacer link having a first end pivotally coupled to the first rotatable element;

a second displacer link having a first end pivotally coupled to the third rotatable element; and a yoke pivotally coupled to second ends of the first and second displacer links, the yoke being pivotally coupled to the displacer piston.

17. The Stirling engine of claim 16, wherein the engine provides a dwell at a bottom dead center location of a stroke of the displacer piston.

18. The Stirling engine of claim 16, wherein the engine provides a dwell at a top dead center location of a stroke of the displacer piston.

* * * * *